United States Patent [19]

Orio et al.

[11] Patent Number: 4,511,403

[45] Date of Patent: Apr. 16, 1985

[54] IMMERSION TIN COMPOSITION AND PROCESS FOR USING

[75] Inventors: Alfred P. Orio, Westford; Leonard R. Levy, Framingham; Michael Gulla, Sherborn, all of Mass.

[73] Assignee: Shipley Company Inc., Newton, Mass.

[21] Appl. No.: 112,781

[22] Filed: Jan. 16, 1980

Related U.S. Application Data

[63] Continuation of Ser. No. 005,667, Jan. 22, 1979, abandoned, which is a continuation of Ser. No. 824,162, Aug. 12, 1977, abandoned.

[51] Int. Cl.[3] ..... C23C 3/02

[52] U.S. Cl. ..... 106/1.22; 106/1.25

[58] Field of Search ..... 106/1.25, 1.22

[56] References Cited

U.S. PATENT DOCUMENTS

| | | | |
|---|---|---|---|
| 2,891,871 | 6/1959 | Ceresa et al. | 106/1.25 |
| 3,303,029 | 2/1967 | Shipley | 106/1.25 |
| 3,689,292 | 9/1972 | Preston | 106/1.25 |
| 3,905,878 | 9/1975 | Dohi et al. | 204/54 R |
| 4,093,466 | 6/1978 | Davis | 106/1.22 |

*Primary Examiner*—Lorenzo B. Hayes

*Attorney, Agent, or Firm*—Robert L. Goldberg

[57] ABSTRACT

This invention is for an immersion tin plating composition capable of depositing tin over metallic surfaces displaceable by tin and to processes using the same. The composition is characterized by an inhibitor that improves the plating characteristics of the solution and permits an increased ratio of thiourea to tin at a relatively high tin concentration without formation of "black tin". The tin plating compositions of this invention are capable of providing an increased yield of good quality tin compared to prior art tin plating compositions.

8 Claims, No Drawings

IMMERSION TIN COMPOSITION AND PROCESS FOR USING

CROSS REFERENCE TO RELATED APPLICATIONS

This application is a continuation of U.S. patent application Ser. No. 005,667 filed Jan. 22, 1979 which is in turn a continuation of U.S. patent application Ser. No. 842,162 filed Aug. 12, 1977, both now abandoned.

BACKGROUND OF THE INVENTION

1. Introduction

This invention relates to acidic aqueous compositions for immersion coating tin over metal surfaces displaceable by tin and processes for using the same.

2. Description of the Prior Art

Immersion tin plating compositions capable of providing tin plate over a copper surface are known and disclosed, for example in U.S. Pat. Nos. 2,282,511; 2,369,620; 2,891,871; 3,303,029 and 3,917,486, all incorporated herein by reference. Such compositions typically comprise a tin salt, a complexing agent for the tin, typically a sulphur complexing agent, especially thiourea, an acid and frequently a reducing agent such as a compound of hypophosphite.

It is known that immersion tin plating compositions plate by displacement whereby theoretically a mole of stannous tin displaces 2 moles of copper thereby introducing 2 moles of copper into solution for each mole of tin plated as a consequence of the plating reaction. As plating continues, the copper over which the tin deposits becomes coated with tin and is thereby less available for displacement. Therefore, as plating proceeds, plating rate decreases until plating substantially stops with little or no further buildup of tin regardless of the amount of tin remaining in the plating composition. Consequently, such compositions are characterized by a relatively low yield of plateable tin from solution.

It is known by applicant that when thiourea is used as a complexing agent, it would be desirable to use a high molar ratio of thiourea to tin and a relatively high tin concentration—i.e., 0.2 moles per liter. This combination increases the "throwing power" of the solution. However, it is also known by applicant that under such conditions, as the ratio of thiourea to tin increases, the deposit formed becomes discolored and non-adherent and is aptly described as "black tin".

SUMMARY OF THE INVENTION

The tin plating compositions of the invention are of the type disclosed in U.S. Pat. Nos. 3,303,029 and 3,917,486 and comprise a base aqueous formulation of a stannous salt, an acid capable of dissolving solution components, thiourea as a complexing agent and preferably a reducing agent such as hypophosphite. In accordance with the invention, the base formulation also contains an inhibitor, preferably a solution soluble organic sulfonic acid or a salt thereof, which results in improved plating and permits the use of a higher ratio of thiourea to tin at a relatively high tin concentration without formation of a black tin deposit. Hence, in accordance with this invention, tin plating compositions are provided that deposit good quality tin in a higher yield than heretofore believed to be possible.

DESCRIPTION OF THE PREFERRED EMBODIMENTS

Though not wishing to be bound by theory, it is believed that as tin deposits over a cuprous metal surface from an immersion tin plating solution, two reactions take place that cause copper to enter solution. The first comprises displacement of two moles of copper for each mole of tin deposited. The second is believed to comprise an etching reaction whereby copper is etched by the plating solution. This latter reaction is evidenced by discoloration of the plating solution from pale yellow to pale green and by a higher concentration of copper in a depleted tin plating solution than can be attributed to the copper entering solution solely by displacement. It is believed that the etching reaction becomes more vigorous as the molar ratio of thiourea to tin increases resulting in the formation of loosely adherent tin referred to herein as black tin. Therefore, though a high thiourea to tin molar ratio at a relatively high tin concentration may be desired, the tin obtained under these conditions is not of a commercially acceptable form. Based upon the theory set forth herein, it has been found that the addition of a compound to a tin plating solution that inhibits etching of copper by the plating solution permits use of a higher thiourea to tin ratio at the higher type concentration with a concomitant increase in tin yield without formation of black tin.

As aforesaid, the compositions of this invention comprise a stannous salt, thiourea, an acid, preferably hypophosphite as a reducing agent and an inhibitor.

Stannous chloride is the preferred source of stannous tin in the tin plating composition though other known acid soluble stannous salts can be used provided the anion of the salt is not detrimental to the performance of the solution. The concentration of the stannous ion is not critical since small amounts provide some deposition but substantial amounts are preferred. A preferred composition comprises 0.01 moles (expressed as metallic tin) to the solubility limit of the compound and more preferably, from 0.05 to 0.2 moles per liter.

In order to maintain the stannous salt soluble in solution, thiourea is used as a complexing agent for the stannous salt, preferably alone but also in combination with other known complexing agents for tin if desired. Other complexing agents that are useful are known in the art and described in the above referenced patents.

The minimum concentration of thiourea in the prior art is generally an amount in excess of that amount necessary to complex the stannous ion initially in solution. This amount is in excess of at least 2 moles of complexing agent per mole of stannous ion. For purposes of this invention, for reasons described above, it has been found that higher concentrations are desired and a preferred ratio is at least 10:1, more preferably, at least 12:1 and most preferably, between 18:1 and 30:1. It has been found that as the ratio exceeds about 30:1, dependent upon the conditions of use and other components in solution, the yield of the plating solution drops and the formation of black tin is again evidenced.

Though the higher ratios of thiourea to tin expressed above are preferred, it has been found that benefits are obtained by the addition of an inhibitor to the plating solution even at the lower ratios in that the solution is capable of greater lattitude in operation. Therefore, the invention comprises the addition of the inhibitor and in the preferred embodiment, the use of the inhibitor in a solution containing an increased molar ratio of thiourea to tin.

An acid is used in the tin composition to dissolve solution components. Typically the acid used is a non-oxidizing mineral acid in an amount sufficient to reduce the pH to 1 or less. Hydrochloric and sulfuric acids are preferred.

The plating composition preferably contains a hypophosphite salt to promote solution stability as is known in the art. Tin deposits from solution by displacement with or without the hypophosphite but in its absence, within a relatively short time, typically within several hours, the solution will become turbid and the deposit properties will be adversely affected. Alkali metal hypophosphites such as sodium hypophosphites are preferred.

The concentration of the hypophosphite, when used, can vary from about 0.01 to about 2.5 moles per liter but preferably is lower than in the prior art as represented, for example, in U.S. Pat. No. 3,303,029. Consequently, the preferred concentration varies from about 0.05 to 1.0 moles per liter, and more preferably from about 0.05 to 0.25 moles per liter.

The tin plating compositions of the invention are characterized by the addition of a compound that inhibits etching of copper as explained above. The preferred inhibitors are organo sulfonic acids and salts thereof, preferably alkali metal salts.

Typical organo sulfonic acids and salts that may be employed in accordance with this invention comprise, for example, phenol sulfonic acid, toluene sulfonic acid, 1-phenol-2-aminosulfonic acid, 2-amino benzene-4 sulfonic acid, xylene sulfonic acid, sulfosalicyclic acid, and salts of each of the foregoing such as alkali metal salts. The preferred sulfonic acids are aromatic sulfonic acids having one aryl nucleus, phenol sulfonic acids and salts thereof being most preferred.

The concentration of inhibitor in the tin solution is difficult to define with precision as it is dependent upon the specific inhibitor used. Some inhibitors can be used within wide concentration ranges whereas others can be used only in narrower concentration ranges. Hence, for some inhibitors, minor amounts of as low as 0.1 grams per liter provide some improvement and and as the concentration increases, greater improvements are obtained up to an optimum amount. Beyond the optimum amount, tin yield drops off probably based upon the inhibitor acting to prevent both copper etching and the displacement reaction. For other inhibitors, the upper limit is of lesser importance. Based upon the above, it should be apparent that any concentration range set forth herein might not be accurate for all inhibitors and the preferred concentration is that which permits a high yield of good quality tin. However, for purposes of a guideline only, the inhibitor concentration preferably varies between about 0.01 and 12 grams per liter and more preferably, between 0.1 and 5 gram per liter.

The tin compositions of this invention are used in a manner similar to the prior art though the pretreatment of the copper surface prior to tin plating should be performed with greater care. A copper substrate such as a copper clad epoxy printed circuit board base material is preferably first pre-dipped in a solution of a wetting agent such as non-ionic, cationic or anionic surfactant. Next, the part is rinsed and etched with a mild etchant that provides a smooth surface on the copper rather than a coarse granular surface. Light mechanical abrasion preceded by a surfactant pre-dip, though lesser preferred, can be used. After pretreatment including water rinse, the copper surface may be immersed in a pre-dip which would have the formulation of the tin plating solution absent the tin or may be immersed directly in the tin solution for a time sufficient to deposit the tin to a desired thickness, preferably in excess of 60 millionths of an inch. The temperature of the plating solution can vary from about room temperature to as high as 200° F. but the composition is preferably used within a temperature ranging between 130° and 160° F. or higher—i.e., 185° to 200° F. for heavier deposits. The tin deposits are used for essentially the same purposes as in the prior art and the preparation of parts for deposition and the use of tin coated surfaces are fully described in the aforesaid U.S. Pat. Nos. 3,303,029 and 3,917,486, the contents of which are incorporated herein by reference.

The tin plating compositions of this invention are particularly useful for the manufacture of printed circuit boards. Procedures for the formation of printed circuit boards are described in numerous publications, for example, in Coombs, PRINTED CIRCUITS HANDBOOK, McGraw-Hill Publishing Company, New York, 1967, Chapter 5, incorporated herein by reference.

In a typical process for the manufacture of printed circuit boards, a suitable base material is selected such as copper clad epoxy. Holes are drilled at appropriate locations on the board and the walls of the holes are metallized such as with copper to provide electrical contact between the two surfaces of the base material. Methods for metallization are known and include the steps of cleaning, catalyzing and electroless copper deposition.

Following metallization of the holes, utilizing a process known as pattern plating, a conductor pattern is formed on the copper by application of an organic resist material which may be either a photoresist or a screen resist dependent upon design and definition. The resist coats the copper that is not part of the conductor pattern and leaves the copper bare in a conductor pattern. The thickness of the conductor pattern is then increased using electroless and/or electrolytic copper plating procedures. Following the steps of copper plating, tin from a plating solution herein is applied over the copper in the conductor pattern to protect the same from subsequently applied etchants, the organic resist is removed exposing the unwanted copper (not part of the conductor pattern), and the unwanted copper is dissolved with a suitable etchant that does not attack tin such as those disclosed in U.S. patent application Ser. No. 822,003 of Aug. 5, 1977, assigned to the same assignee as the subject invention and incorporated herein by reference. Such etchants comprise sulfuric acid activated with hydrogen peroxide or the synergistic combination of hydrogen peroxide and molybdenum and characterized by a source of phosphate ions as an inhibitor against attack on tin. During etching, the copper coated with tin is protected from the etchant such that following etching, there is provided copper in a conductor pattern coated with tin. Thereafter, electrical connections can be joined directly to the tin if desired. Preferably, the tin is reflowed by heating the circuit to a temperature above the melting point of the tin prior to joining electrical connections thereto.

EXAMPLES 1–7

Seven tin plating formulations were prepared and seven clean copper foils, each having a surface area of 36 square inches, were pretreated by immersion in a peroxide-sulfuric etch identified as 746 Etch of Shipley Company Inc. and water rinsed. One foil was then immersed in each solution. Plating was permitted to continue until it could be visually observed that tin of inferior quality was beginning to deposit or the solution was no longer capable of depositing tin. This was in part evidenced by a change in color of the solution from pale yellow to pale green indicative of copper etching. At this point, the foil was removed and the amount of tin plated from solution determined. The formulations and results are as follows:

| | 1 | 2 | 3 | 4 | 5 | 6 | 7 |
|---|---|---|---|---|---|---|---|
| Stannous chloride (gm) | 20 | 20 | 20 | 20 | 20 | 20 | 20 |
| Hydrochloric acid (37% ml) | 25 | 25 | 25 | 25 | 25 | 25 | 25 |
| Sulfuric acid (50% ml) | 50 | 50 | 50 | 50 | 50 | 50 | 50 |
| Sodium hypophosphite (gm) | 16 | 16 | 16 | 16 | 16 | 16 | 16 |
| Thiourea | 200 | 200 | 200 | 200 | 200 | 200 | 200 |
| Phenolsulfonic acid | 0 | 0.1 | 0.25 | 0.5 | 1.0 | 25 | 50 |
| Water | | | to 1 liter | | | | |
| Temperature (°F.) | 160 | 162 | 160 | 164 | 160 | 160 | 160 |
| Results:(1) | | | | | | | |
| % tin plated | 21 | 21 | 35 | 52 | 48 | 45 | 48 |
| Tin appearance(2) | B | B | B | S | S | S | S |

(1)Determined by chelometric titration with EDTA titrant and methyl thymol blue indicator.
(2)B = black tin, S = satisfactory deposit

EXAMPLES 8–23

The following examples illustrate the effect of the thiourea to tin ratio with and without the use of phenol sulfonic acid as a stabilizer. The base formulation used was as follows:

| | |
|---|---|
| Stannous chloride | variable |
| Hydrochloric acid (37%) ml | 25 |
| Sulfuric acid (50%) ml | 50 |
| Sodium hypophosphite (gm) | 16 |
| Thiourea (gm) | variable |
| Phenol sulfonic acid (gm) | variable |
| Water | to 1 liter |

The concentrations of the components used in varying quantities and the results obtained using the plating procedure of Examples 1–6 are as follows:

| Example No. | Thiourea (g) | Stannous Chloride (g) | Phenol Sulfuric Acid (g) | Mole Ratio Thiourea to Tin | Results Yield | Results Appearance |
|---|---|---|---|---|---|---|
| 8 | 50 | 20 | 0 | 6.4:1 | 13.6 | Satisfactory |
| 9 | 50 | 15 | 0 | 8.6:1 | 7.4 | Satisfactory |
| 10 | 50 | 10 | 0 | 12.9:1 | 4.3 | Satisfactory |
| 11 | 50 | 5 | 0 | 25.8:1 | 12.9 | Satisfactory |
| 12 | 200 | 20 | 0 | 25.8:1 | 20.3 | Black |
| 13 | 200 | 15 | 0 | 34.6:1 | 10.2 | Black |
| 14 | 200 | 10 | 0 | 51.6:1 | 10.9 | Black |
| 15 | 200 | 5 | 0 | 103.2:1 | 10.5 | Black |
| 16 | 50 | 20 | 3 | 6.4:1 | 15.5 | Satisfactory |
| 17 | 50 | 15 | 3 | 8.6:1 | 11.2 | Satisfactory |
| 18 | 50 | 10 | 3 | 12.9:1 | 8.1 | Satisfactory |

-continued

| Example No. | Thiourea (g) | Stannous Chloride (g) | Phenol Sulfuric Acid (g) | Mole Ratio Thiourea to Tin | Results Yield | Results Appearance |
|---|---|---|---|---|---|---|
| 19 | 50 | 5 | 3 | 25.8:1 | 54.5 | Satisfactory |
| 20 | 200 | 20 | 3 | 25.8:1 | 47.4 | Satisfactory |
| 21 | 200 | 15 | 3 | 34.6:1 | 24.0 | Satisfactory |
| 22 | 200 | 10 | 3 | 51.6:1 | 28.5 | Black |
| 23 | 200 | 5 | 3 | 103.2:1 | 24.2 | Black |

The above table illustrates that in the absence of an inhibitor, ratios of up to about 25:1 can be tolerated without formation of black tin at the relatively low tin concentrations (5 grams per liter). However, with higher concentrations of tin, even at a ratio of 25:1, black tin forms. By comparison, in those examples where an inhibitor is used, higher ratios at higher tin concentrations can be used, and moreover, substantially greater yields of tin are obtained, particularly with a molar ratio of thiourea to tin of about 25:1.

EXAMPLES 24–27

Examples 20 to 23 were repeated increasing the concentration of the phenol sulfonic acid to 9 grams and with the addition of 0.6 grams of a surfactant to the formulation with results as follows:

| Example No. | Mole Ratio Thiourea to Stannous Chloride | Results Yield | Results Appearance |
|---|---|---|---|
| 24 | 25.8:1 | 44.6 | Satisfactory |
| 25 | 34.6:1 | 55.8 | Satisfactory |
| 26 | 51.6:1 | 8.9 | Black |
| 27 | 103.2:1 | 9.2 | Black |

The results obtained are quite similar to those obtained in the preceding four examples though the yield was reduced at the higher ratios.

EXAMPLE 28

Using the base formulation and plating procedure of Example 1, the example was repeated adding benzene disulfonic acid in an amount of 3 grams per liter. It was found that the yield was 47.4% and the deposit was satisfactory.

EXAMPLE 29

A printed circuit board is prepared from a copper clad G-10 substrate using the following sequence of steps:

(a) Clean the substrate and drill holes at appropriate locations.
(b) Metallize the walls of the holes by electroless plating including the steps of catalysis with a catalyst such as Catalyst 6F of Shipley Company Inc., accelerate with a mild acid solution and electrolessly plate copper such as with copper mix CP-74 of Shipley Company Inc.
(c) Apply a positive working photoresist such as AZ-119, expose and develop.
(d) Electroplate copper to full desired thickness.
(e) Apply the immersion tin of Example 5 over the exposed copper.
(f) Remove the photoresist by dissolution in a suitable solvent.

(g) Remove exposed copper by immersion of the epoxy coated board in an etchant comprising 200 ml of 50% sulfuric acid, 100 ml of 35% hydrogen peroxide, 10 grams of sodium molybdate, 16 gm of phenol sulfonic acid, 50 ml of 85% of phosphoric acid and water to 1 liter. The etchant is maintained at 120° F. and the time of immersion is sufficient to remove all of the copper not coated with tin.

(h) Heat circuit board to above melting point of the tin to reflow the same.

We claim:

1. In an immersion plating solution for tin that plates over a base metal by displacement, said solution containing stannous ions in an amount of at least 0.05 moles per liter, thiourea in an amount such that the mole ratio of thiourea to stannous tin is at least 10:1, and a mineral acid in an amount sufficient to reduce the solution pH to below 1, the improvement comprising an aromatic mononuclear sulfonic acid in solution in an amount sufficient to prevent the formation of a loosely adherent, discolored immersion tin deposit.

2. The solution of claim 1 containing a hypophosphite.

3. The solution of claim 1 where the sulfonic acid is a phenol sulfonic acid.

4. The solution of claim 1 where the stannous ions are present in an amount of from 0.05 to 0.2 moles per liter.

5. The solution of claim 4 where the ratio of thiourea to stannous ions is at least 12:1.

6. The solution of claim 4 where the ratio of thiourea to stannous ions varies between about 18:1 and 30:1.

7. The solution of claim 6 where the sulfonic acid is present in an amount varying between 0.01 grams per liter and that amount that retards the displacement reaction.

8. The solution of claim 7 where the sulfonic acid is present in an amount of from 0.1 to 3 grams per liter.

* * * * *